United States Patent [19]

Mikami

[11] 4,275,145

[45] Jun. 23, 1981

[54] METHOD FOR DISPERSING OIL-SOLUBLE PHOTOGRAPHIC ADDITIVES

[75] Inventor: Takeshi Mikami, Minami-ashigara, Japan

[73] Assignee: Fuji Photo Film Co., Ltd., Minami-ashigara, Japan

[21] Appl. No.: 102,514

[22] Filed: Dec. 11, 1979

[30] Foreign Application Priority Data

Dec. 27, 1978 [JP] Japan ..... 53-161924

[51] Int. Cl.[3] ..... G03C 1/40; G03C 1/84

[52] U.S. Cl. ..... 430/377; 430/217; 430/222; 430/223; 430/449; 430/512; 430/546; 430/631; 430/640

[58] Field of Search ..... 430/377, 493, 546, 217, 430/512, 222, 223, 631, 640

[56] References Cited

U.S. PATENT DOCUMENTS

| | | | |
|---|---|---|---|
| 2,186,717 | 1/1940 | Eggert et al. | 430/546 |
| 4,140,530 | 2/1979 | Trunley et al. | 430/546 |

FOREIGN PATENT DOCUMENTS

| | | | |
|---|---|---|---|
| 2902327 | 7/1979 | Fed. Rep. of Germany | 430/546 |

*Primary Examiner*—J. Travis Brown

*Attorney, Agent, or Firm*—Sughrue, Rothwell, Mion, Zinn and Macpeak

[57] ABSTRACT

A method for dispersing an oil-soluble photographic additive into a hydrophilic colloid composition is disclosed wherein a solution of an oil-soluble photographic additive in an organic solvent or the melted oil-soluble photographic additive is dispersed in a hydrophilic colloid containing an anionic surface active agent and lecithin together with a gelatin derivative.

15 Claims, No Drawings

METHOD FOR DISPERSING OIL-SOLUBLE PHOTOGRAPHIC ADDITIVES

BACKGROUND OF THE INVENTION

1. Field of the Invention

The present invention relates to a method of blending oil-soluble photographic additives into a hydrophilic colloid layer and, in particular, to a method of dispersing oil-soluble photographic additives into a hydrophilic colloid composition or into water.

2. Description of the Prior Art

In the manufacture of a photographic silver halide emulsion layers or other hydrophilic colloid coatings, one must often blend water-insoluble or sparingly soluble compounds (hereinafter referred to as "oil-soluble photographic additives") in such coatings. It may further be required that such additives which are insoluble in the hydrophilic colloid vehicle be uniformly dispersed in the form of extremely fine particles.

A typical color photographic light-sensitive material is based on a silver halide emulsion, though other types of materials are known using various other kinds of light-sensitive components. Such silver halide color photographic materials comprise principally a support, a red-sensitive silver halide emulsion layer, a green-sensitive silver halide emulsion layer and a blue-sensitive silver halide emulsion layer, each provided on said support. Various arrangements and constructions of silver halide color photographic materials may be employed for different types of imaging processes including, for example, diffusion transfer color photography and silver dye bleach color photography. Mixed grain photographic products and multilayer products are also known.

A number of recent advances in color photographic technology have been brought about by the use of oil-soluble photographic additives, which are dissolved in substantially water-insoluble, high boiling organic solvents (for example, high boiling point organic solvents) and then dispersed into a hydrophilic colloid aqueous solution with the aid of an anionic surface active agent as an emulsifier. Such oil-soluble photographic additives include oil soluble couplers, UV absorbing agents, fade preventing agents, antioxidants, dye precursors for color diffusion transfer, dye developers, etc.

Various methods are known for emulsifying and dispersing such oil-soluble photographic additives including methods disclosed in U.S. Pat. Nos. 2,739,888, 3,352,681, etc. for dispersing UV absorbing agents; the methods disclosed in U.S. Pat. Nos. 2,360,290, 2,728,659, 3,700,453, etc. for dispersing diffusion-resistant alkylhydroquinones used for preventing color fog, color stain and color mixing, etc.

Usually, anionic surfactants are used to disperse oil-soluble photographic additives. For example, the method set forth in U.S. Pat. No. 2,332,027 employs Gardinol WA (a sulfonated coconut fatty alcohol, Du Pont de Nemours & Co.) and triisopropylnaphthalenesulfonates. Japanese Pat. No. 428,191 discloses a method based on the use of water-soluble coupler containing a sulfonic group or a carboxyl group together with a long-chain aliphatic group as an emulsifier. U.S. Pat. No. 3,676,141 describes a method relying upon a combination of an anionic surfactant containing a sulfonic group and a nonionic surfactant containing an anhydrohexyl ester unit.

In designing and fabricating a color photographic product, the light-sensitive coatings have finite thickness and the presence of incorporated additives in the form of coarse particles in the coatings can cause light scattering and deteriorate the transparency of the finished product. Furthermore, the image sharpness as well as the graininess of the photograph can be remarkably deteriorated. In contrast, when a coupler is dispersed as fine particles, the surface area per unit of weight of the coupler increases which in turn increases the rate and the efficiency of dye development, thus bringing about an improvement in the covering power of the resulting color image and increase in developing speed.

Accordingly, it is important that the growth of coarse particles during storage of an emulsified product be prevented. Emulsified products prepared by either of the methods cited above exhibit insufficient storage stability. In particular, when they are stored for an extended period of time at low temperatures, or for 24 hours at 40° C., the growth of coarse particles is unavoidable.

SUMMARY OF THE INVENTION

A principal object of the present invention is to remove the above-described defects. That is an object of the present invention is to provide an emulsion containing oil-soluble photographic additives with excellent stability such that aggregation of particles and crystal deposits under storage conditions at high or low temperatures for a long period of time is prevented.

The above objects of the present invention have been achieved by dispersing a solution obtained by dissolving an oil-soluble photographic additive in at least one organic solvent or dispersing a liquid obtained by melting an oil-soluble photographic additive, into a hydrophilic colloid composition containing an anionic surface active agent and lecithin together with a gelatin derivative.

DETAILED DESCRIPTION OF THE INVENTION

The term "gelatin derivative" used herein means a gelatin derivative having a structure wherein a substituent is introduced into an amino group or a carbonyl group of the gelatin and the derivative still maintains the essential characteristics of gelatin. Examples of the gelatin derivatives which can be used in the present invention include the reaction products of gelatin and an acid anhydride as described in U.S. Pat. No. 2,614,928, reaction products of gelatin and an isocyanate or reaction products of gelatin and a compound having an active halogen atom. The aforementioned acid anhydrides include, for example, maleic anhydride, phthalic anhydride, benzoic anhydride, acetic anhydride, isatoic anhydride, succinic anhydride, etc. The aforementioned isocyanate compounds include, for example, phenyl isocyanate, p-bromophenyl isocyanate, p-chlorophenyl isocyanate, p-tolyl isocyanate, p-nitrophenyl isocyanate, naphthyl isocyanate, etc.

Representative examples of compounds having an active halogen atom are acyl chlorides and arylsulfonyl chlorides such as benzenesulfonyl chloride, p-methoxybenzenesulfonyl chloride, p-phenoxybenzenesulfonyl chloride, p-bromobenzenesulfonyl chloride, p-toluenesulfonyl chloride, m-nitrobenzenesulfonyl chloride, m-sulfobenzoyl dichloride, naphthalene-$\beta$-sulfonyl chloride, p-chlorobenzenesulfonyl chloride, 3-nitro-4-aminobenzenesulfonyl chloride, 2-carboxy-4-bromobenzenesulfonyl chloride, m-carboxybenzenesulfonyl chloride, 2-amino-5-methylbenzenesulfonyl chloride, phthalyl chloride, p-nitrobenzoyl chloride, benzoyl chloride, ethyl chlorocarbonate, furoyl chloride, etc.

The term "lecithin" as used herein is the product obtained as the acetone-insoluble ingredient resulting from the extraction with acetone of a wholly lipid mixture extracted from organic matter, such as soybean, cattle liver, egg yolk, milk, Indian corn, etc. Lecithin is a mixture of phospholipids and consists mainly of phosphatidylchloin which amounts to 60 to 70% of the total phospholipid content. Other phospholipids which may be present include phosphatidylethanolamine, inositolphosphatide. Lecithin is a well known natural emulsifying agent which is non toxic and is suitable as an emulsifier for foodstuffs. Its effects as emulsifying agent are more or less determined by the other ingredients with which it is used. It is commercially available as Lecithin W.D. (made by Troy Chemical Co., Ltd.), Kelecin F, Kelecin FB, Kelecin FD (made by Spencer Kellog, Div. of Textron Inc.)

Attempts were made to disperse oil-soluble additives using various types of lecithin itself but they did not produce emulsions stable enough that the incorporated additive would not separate out during storage or during the manufacture of the photographic product. Unexpectedly, however, it has been found that the combined use of a gelatin derivative with lecithin provides an emulsion stabilizing effect. In other words, the gelatin derivative acts together with lecithin and the anionic surfactant to yield the gelatin derivative emulsion of extremely fine particle size, which shows a very high stability upon storage over a very long period of time. The effect achieved far exceeds the effect achieved using the gelatin derivative alone in a hydrophilic colloid.

The anionic surface active agents which can be used in the present invention include any conventionally known anionic surface active agents.

Nonionic surface active agents can be used in combination with the anionic surface active agents of the present invention. Representative examples of the nonionic surface active agents are, for example, saponin (steroid type), alkyleneoxide derivatives (for example, polyethylene glycol, polyethylene glycol/polypropylene glycol condensation products, polyethylene glycol alkyl or polyethylene glycol alkylaryl ethers, polyethylene glycol esters, polyethylene glycol sorbitol esters, polyalkylene glycol alkylamines or alkylamides, or polyethyleneoxide adducts of silicone), glycidol derivatives (for example, alkenyl succinic acid polyglycerides or alkylphenol polyglycerides), fatty acid esters of polyvalent alcohols, alkyl esters of saccharides, urethanes of saccharides, ethers of saccharides, etc.

Representative examples of the anionic surface active agents are anionic surface active agents containing an acidic group such as a carboxy group, a sulfo group, a phospho group, a sulfuric acid ester group, a phosphoric acid ester group, etc., for example, triterperiod type saponium, alkyl carbonates, alkyl sulfonates, alkylbenzene sulfonates, alkylnaphthalene sulfonates, alkyl sulfuric acid esters, alkyl phosphoric acid esters, N-acyl-N-alkyltaurines, sulfosuccinic acid esters, sulfoalkyl polyoxyethylene alkylphenyl ethers, polyoxyethylene alkyl phosphoric acid esters, etc. Of these compounds, a compound having in its molecular structure a hydrophobic moiety containing 8 to 30 carbon atoms and an —$SO_3M$ group or —$OSO_3M$ group (wherein M is a cation capable of forming a salt with sulfuric acid or sulfonic acid) is particularly preferred. Specific examples of M are an alkali metal ion, an alkaline earth metal ion, an ammonium ion and a quaternary ammonium ion. When M is an alkaline earth metal ion, the compound forms a salt in a form of $(—SO_3)_2M$ or $(—OSO_3)_2M$. Hereinafter, such anionic surfactants will be referred to as "sulfonic acid type" and "sulfate type" anionic surfactants. These types of surfactant are described in *Synthesis and Application of Surface Active Agents,* authored by R. Oda and K. Teramura, published by Maki Publishing Co., and *Surface Action Agents,* authored by A. W. Perry (Interscience Publications Inc. New York).

Examples of the above-cited anionic surface active agents are listed below.

Compound A-1 $C_{12}H_{25}OSO_3Na$
Compound A-2 $C_{14}H_{29}OSO_3Na$
Compound A-3 Turkey red oil
Compound A-4 $C_{12}H_{25}CONHCH_2CH_2OSO_3Na$
Compound A-5 $C_{12}H_{25}SO_3Na$
Compound A-6 $C_{14}H_{29}SO_3Na$
Compound A-7

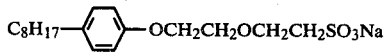

Compound A-8

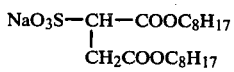

Compound A-9

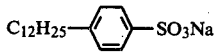

Compound A-10

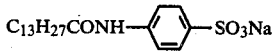

Compound A-11

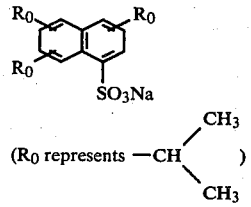

In this specification, the oil-soluble photographic additives are those additives which cannot be dissolved in water in amounts exceeding 3% by weight at room temperature (about 20° C.).

Oil-soluble photographic additives which can be emulsified and dispersed in accordance with the present invention include, for example, oil soluble couplers, DIR colorless coupling compounds, UV light absorbing agents, fade preventing agents, antioxidants, dye precursors for color diffusion transfer, dye developers, etc.

The oil soluble couplers to which the present invention can be applied are:

Yellow couplers, generally open chain diketomethylene type compounds such as disclosed in U.S. Pat. Nos. 3,341,331, 2,874,057 and 3,551,155, German Patent Application (OLS) No. 1,547,868, U.S. Pat. Nos. 3,265,506, 3,582,322 and 3,725,072, German Patent Application (OLS) No. 2,162,899, U.S. Pat. Nos. 3,369,895 and 3,408,194, German Patent Application (OLS) Nos. 2,057,941, 2,213,461, 2,219,917, 2,261,361 and 2,263,875, etc.

Magenta couplers such as 5-pyrazolone type compounds, though indazolone type compounds and cyanoacetyl compounds can also be used, such as described in U.S. Pat. Nos. 2,439,098, 2,600,788, 3,062,653 and 3,558,319, British Pat. No. 956,261, U.S. Pat. Nos. 3,582,322, 3,615,506, 3,519,429, 3,311,476 and 3,419,391, Japanese Patent Application (OPI) Nos. 111,631/1974, and 13,041/1975 (The term "OPI" as used herein refers to a "published unexamined Japanese patent application".), German Pat. No. 1,810,464, Japanese Patent Publication No. 2016/1969, Japanese Patent Application (OPI) No. 131,448/1974, U.S. Pat. No. 2,983,608, etc.

Cyan couplers such as phenol or naphthol derivatives described in U.S. Pat. Nos. 2,369,929, 2,474,293, 2,698,794, 2,895,826, 3,311,476, 3,458,315, 3,560,212, 3,582,322, 3,591,383, 2,434,272, 2,706,684, 3,034,892 and 3,583,971, German Patent Application (OLS) No. 2,163,811, Japanese Patent Publication No. 28,836/1970, Japanese Patent Application (OPI) No. 122,335/1974, etc.

Colored couplers such as disclosed in U.S. Pat. Nos. 3,476,560, 2,521,908 and 3,034,892, Japanese Patent Publication Nos. 2016/1969, 22335/1963, 11304/1967 and 32461/1969, Japanese Patent Application Nos. 98469/1974 and 118,029/1975, German Patent Application (OLS) No. 2,418,959, etc.

The present invention is also applicable to so-called DIR couplers which liberate a development inhibitor upon chromogenic reaction. Such couplers are disclosed in, for example, U.S. Pat. Nos. 3,227,554, 3,617,291, 3,701,783, 3,790,384 and 3,632,345, German Patent Application (OLS) Nos. 2,414,006, 2,454,301 and 2,454,329, British Pat. No. 953,454, Japanese Patent Application No. 146,570/1975, etc.

The present invention is also applicable to DIR non-color forming coupling compounds. Such compounds include those disclosed in, for example, U.S. Pat. Nos. 3,297,445 and 3,379,529, and German Patent Application (OLS) No. 2,417,914, etc.

In order to meet the particular requirements of a specific photographic material, two or more couplers or compounds described above can be emulsified at the same time. The following are typical examples of oil-soluble compounds to which the present invention is applicable, however, the present invention can be used in conjunction with oil-soluble additives in general. These examples are only provided to give the reader an idea of the applicability of the invention.

Yellow Dye Forming Coulpers:

Y-1

-continued

Yellow Dye Forming Coulpers:

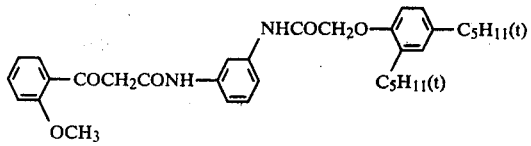

Y-2

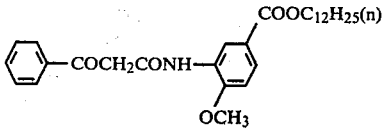

Y-3

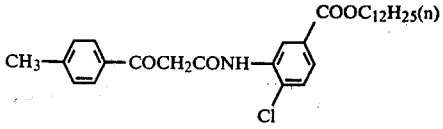

Y-4

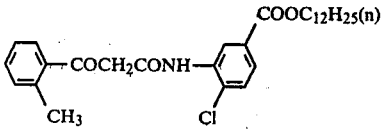

Y-5

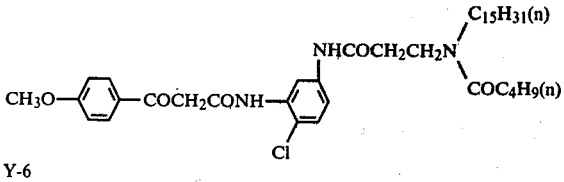

Y-6

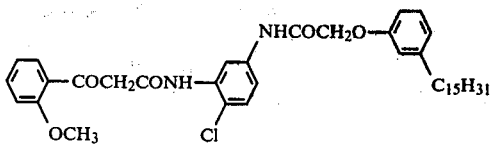

Y-7

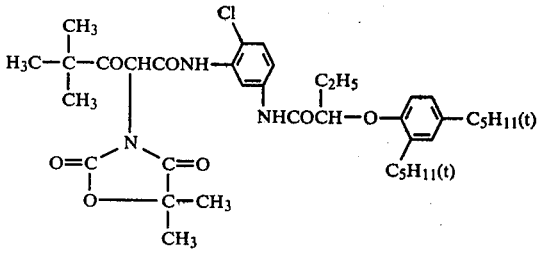

Magenta Dye Forming Couplers:

M-1

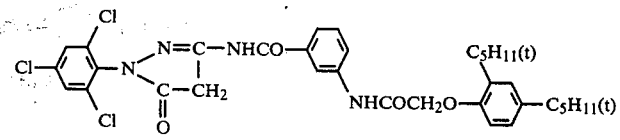

M-2

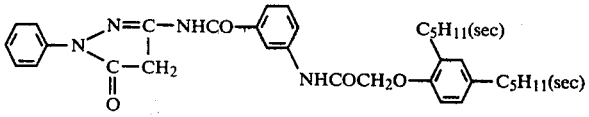

M-3

-continued
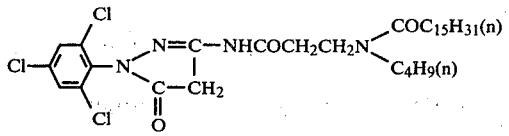
M-4
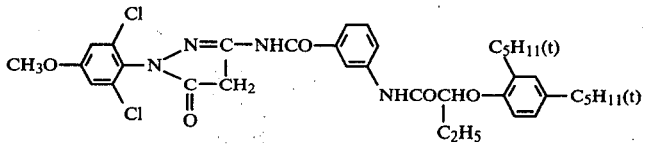
M-5
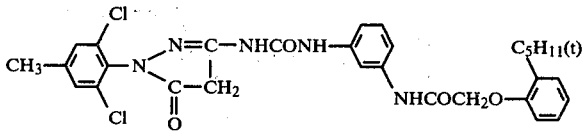
M-6
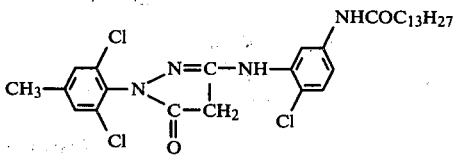
Cyan Dye Forming Couplers:
C-1
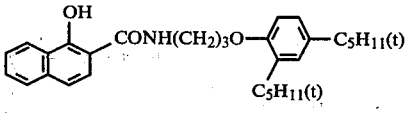
C-2
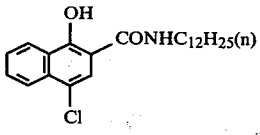
C-3
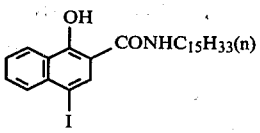
C-4
-continued
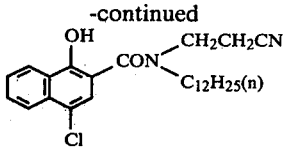
C-5
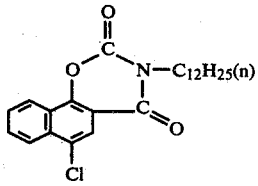
C-6
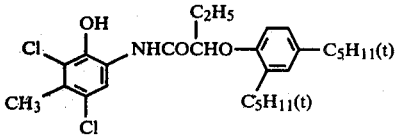
Mask Forming Colored Couplers:
L-1
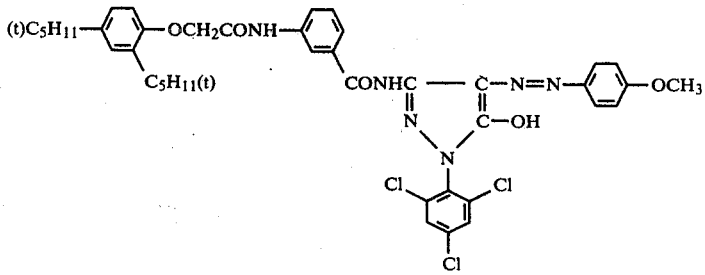
L-2

-continued

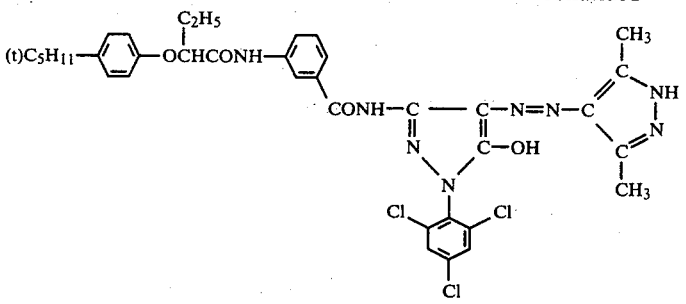

L-3

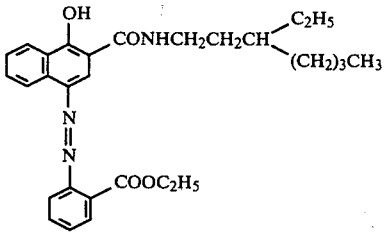

L-4

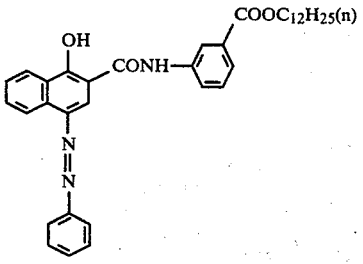

DIR Couplers (Development Inhibitor Releasing Coupler):

N-1

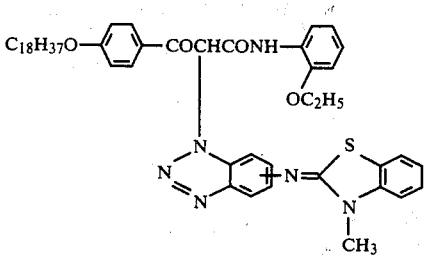

N-2

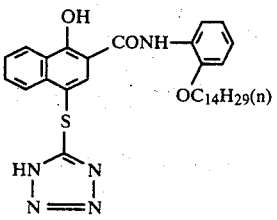

N-3

-continued

DIR Couplers (Development Inhibitor Releasing Coupler):

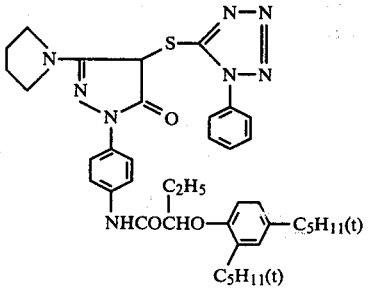

Oil-soluble UV absorbing agents which can be used in conjunction with the present invention include those set forth in, for example, Japanese Patent Publication No. 21687/1967, U.S. Pat. Nos. 3,533,794, 3,794,493 and 3,707,375.

Several exemplary compounds of such oil-soluble UV absorbing agents to which the present invention is applicable are illustrated below.

U-1

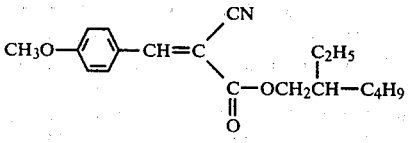

U-2

-continued

U-3

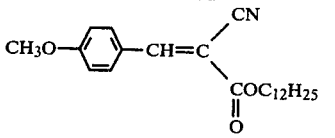

U-4

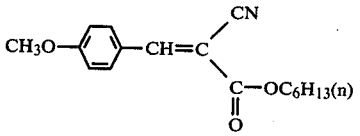

U-5

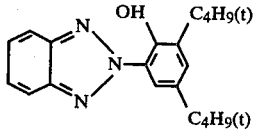

U-6

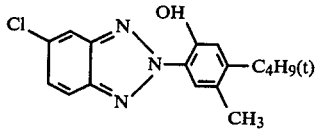

U-7

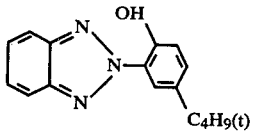

The method of the present invention can also be applied to oil-soluble antioxidants such as are set forth in U.S. Pat. Nos. 2,336,327, 2,728,659 and 2,835,579, Japanese patent application (OPI) No. 2128/1971, etc.

Some specific examples of the oil-soluble antioxidants are exemplified below:

AO-1

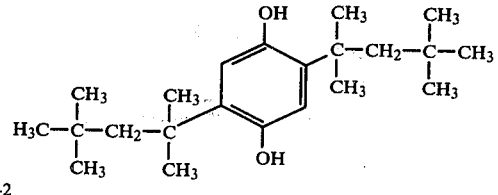

AO-2

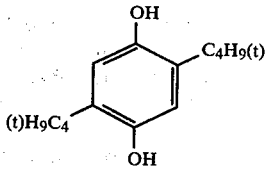

Fade preventing agents for the finished dye image to which the present invention is applicable include those set forth in, for example, U.S. Pat. No. 3,764,337, German Pat. No. 1,547,684, British Pat. No. 1,347,556, etc.

Oil-soluble dye precursors to which the present invention is applicable and which can be employed in diffusion transfer color photographic elements include, for example, dye releasing redox compounds set forth in Japanese patent application (OPI) Nos. 11424/1974, 115528/1975 and 10992/1976, and U.S. Pat. Nos. 3,928,312, 3,932,381, 3,942,987, and 4,055,428, etc. Examples are shown below.

DR-1

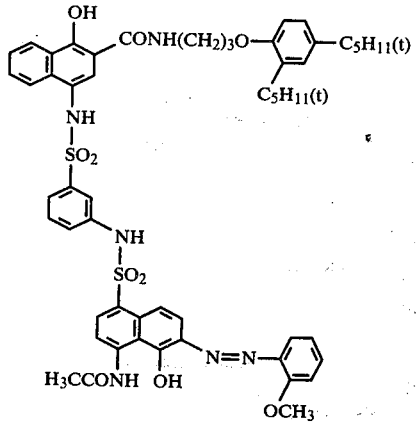

DR-2

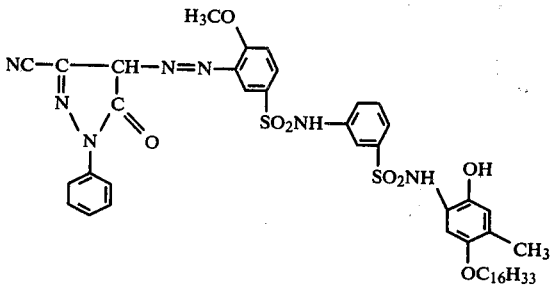

DR-3

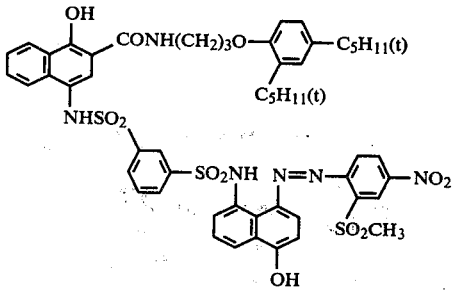

DR-4

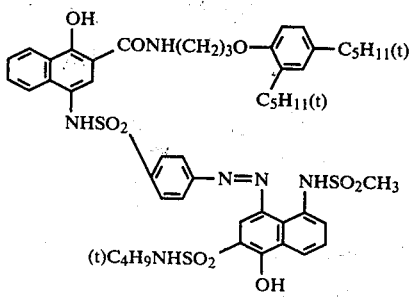

DR-5

-continued

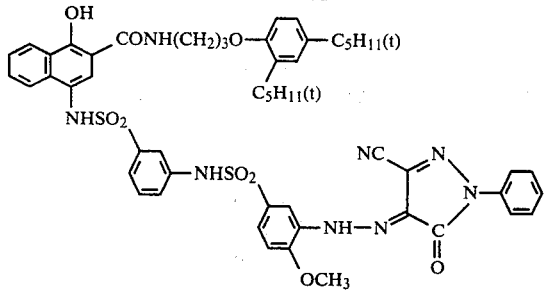

Furthermore, the present invention can be used in conjunction with compounds releasing dyes upon coupling reaction as set forth in British Pat. Nos. 840,731, 904,364, 904,365 and 1,038,331, U.S. Pat. Nos. 3,227,551 and 3,327,554, etc., those compounds that can provide dyestuffs upon coupling reaction and those are set forth in British Pat. Nos. 840,731 and 904,364, U.S. Pat. Nos. 3,227,551 and 3,227,554, etc., and dye developers set forth in U.S. Pat. Nos. 3,415,644, 3,415,645, 3,415,646, 3,594,164 and 3,594,165.

Some exemplary dye developers to which the present invention is applicable are illustrated below.

DD-1

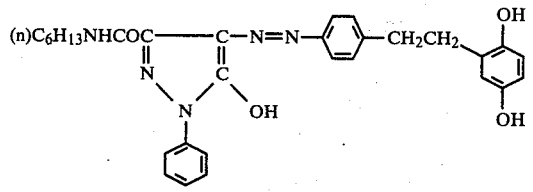

DD-2

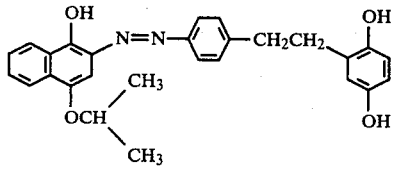

DD-3

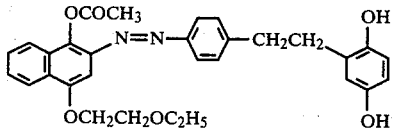

DD-4

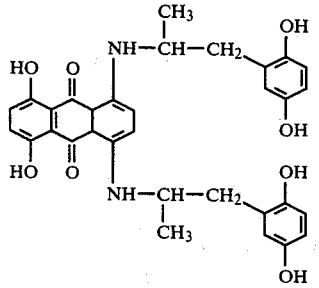

In practicing the method of the present invention, the oil-soluble photographic additive must be melted or fused by heat or dissolved in an organic solvent prior to emulsification. Only additives that have a melting point below about 90° C. can be emulsified directly through thermal fusion.

The organic solvents used to finely disperse the oil-soluble photographic additive in the aqueous medium (to provide an oily phase) are preferably substantially immiscible in water and have a boiling point of at least 190° C. at atmospheric pressure. Such high boiling organic solvents are described, for example, in U.S. Pat. Nos. 2,322,027, 2,533,514, and 2,835,579, Japanese Patent Publication No. 23233/1971, U.S. Pat. No. 3,287,134, British Pat. No. 958,441, Japanese Patent Application (OPI) No. 1031/1972, British Pat. No. 1,222,753, U.S. Pat. No. 3,936,303, Japanese Patent Application (OPI) Nos. 26037/1976 and 82078/1975, U.S. Pat. Nos. 2,353,262, 2,852,383, 3,554,755, 3,676,137, 3,676,142, 3,700,454, 3,748,141 and 3,837,863, German Patent Application (OLS) No. 2,538,889, Japanese Patent Application (OPI) Nos. 27921/1976, 27922/1976, 26035/1976, 26036/1976 and 62632/1975, Japanese Patent Publication No. 29461/1974, U.S. Pat. Nos. 3,748,141, etc.

High boiling organic solvents advantageously used in the present invention include esters (e.g., phthalates, phosphates, citrates, benzoates, fatty acid ester, carbonates, etc.), amides (e.g., fatty acid amides, sulfonamides, etc.), ethers (e.g., allyl ethers, etc.), alcohols, paraffins, etc. Most preferably used are high boiling organic solvents, for example, phthalate esters (e.g., dibutyl phthalate, dihexyl phthalate, diheptyl phthalate, dioctyl phthalate, dinonyl phthalate, didecyl phthalate, butylphthalylbutyl glycolate, dibutyl monochlorophthalate, etc.), phosphoric acid esters (e.g., tricresyl phosphate, trixylelyl phosphate, tris(isopropylphenyl) phosphate, tributyl phosphate, trihexyl phosphate, trioctyl phosphate, trinonyl phosphate, tridecyl phosphate, trioleyl phosphate, tris(butoxyethyl) phosphate, tris(-chloroethyl) phosphate, tris(dichloropropyl) phosphate, etc.), citric acid esters (e.g., o-acetyltriethyl (or butyl, hexyl, octyl, nonyl, decyl) citrate, triethyl (or butyl, hexyl, octyl, nonyl, decyl, tridecyl) citrate, etc.), benzoic acid esters (e.g., butyl (or hexyl, heptyl, octyl, nonyl, decyl, dodecyl, tridecyl, tetradecyl, hexadecyl, octadecyl, oleyl, etc.) benzoate, pentyl o-methylbenzoate, decyl p-methylbenzoate octyl o-chlorobenzoate, lauryl p-chlorobenzoate, propyl 2,4-dichlorobenzoate, octyl 2,4-dichlorobenzoate, stearyl 2,4-dichlorobenzoate, oleyl 2,4-dichlorobenzoate, octyl p-methoxybenzoate, etc.), fatty acid esters (e.g., hexadecyl mylistate, dibutoxyethyl succinate, dioctyl adipate, dioctyl azelate, decamethylene-1,10-diol diacetate, triacetin, tributin, benzyl caprate, pentaerythritol tetra-caproate, isosorbide dicaprylate, etc.), amides (e.g., N,N-dimethyllauramide, N-N-diethylcaprylamide, N-butylbenzenesulfonamide, etc.), trioctyl trimellitate, chlorinated paraffin, etc.

Occasionally in the practice of the present invention, it is advantageous to employ, together with a high boiling solvent cited above, a low boiling point solvent (having a boiling point not exceeding 130° C.) or a high boiling water-soluble solvent to dissolve the oil-soluble photographic additive. Such a water-soluble high boiling point solvent or a low boiling solvent include, for example, propylene carbonate, ethyl acetate, butyl acetate, ethyl propionate, sec-butyl alcohol, tetrahydrofuran, cyclohexanone, dimethylformamide, diethyl sulfoxide, methyl cellosolve, carbinol, etc.

The emulsifying apparatus used to practice the present invention should preferably be such as to be able to impart a large stress on the liquid to be treated, or to transmit ultrasonic energy of high intensity. Suitable apparatuses include a colloid mill, a homogenizer, a micro-porous emulsifier, a liquid siren, an electromagnetic strain type ultrasonic generator, and an emulsifier provided with Pollmann's whistle.

A suitable amount for the gelatin derivative, the lecithin and the anionic surface active agent (each) used in the present invention depends on the type of the oil-soluble photographic additive to be dispersed (e.g., coupler, UV absorber, antioxidant, dye precursor for diffusion transfer color process, etc.), the kind and the amount of the dispersing solvent, the nature and amount of any other coexisting surfactants, and the type of the resulting color photographic product. However, the amount of the lecithin and the anionic surface active agent is usually about 0.5 to 50% by weight (each) based on the weight of the substance to be dispersed, i.e., the solution obtained by dissolving the oil-soluble photographic additive in the dispersing solvent. Also, the amount of the gelatin derivative used in the present invention is appropriately about 1/50 to 10 times by weight (preferably 0.2 to 5 times) based on the weight of the substance dispersed. A weight ratio for the amount of lecithin to the amount of anionic surface active agent is about 1/10 to 10.

In the present invention, the lecithin and/or the anionic surface active agent can be present either in the organic solvent or in water or the hydrophilic colloid composition at the initial stage, giving substantially similar results in either case.

As a hydrophilic colloid in the hydrophilic colloid composition used in the present invention, a binder or a protective colloid conventionally used in silver halide photographic light-sensitive materials can be used together with the gelatin derivative. In this case the gelatin derivative is used in an amount of 100% to 5% based on the total colloid amount used.

In practicing the present invention, one can remove the low boiling solvents employed in order to improve the stability of the resulting dispersion. Further, to enhance the dispersion stability, one can incorporate a dispersion of a synthetic polymeric material which is substantially insoluble or sparingly soluble in water into the finished dispersion of the oil-soluble photographic additive prepared in accordance with the present invention.

Gelatin is most preferably used as a binder or protective colloid which can be used together with the gelatin derivative in the present invention, though, of course, other hydrophilic colloids may also be used. Other suitable hydrophilic materials include, for example, protein such as graft polymers comprising gelatin and other polymeric materials, albumin, casein, etc.; cellulose derivatives such as hydroxyethyl cellulose, carboxymethylcellulose, the sulfuric acid ester of cellulose, etc.; saccharide derivatives such as sodium alginate, starch derivatives, etc.; various synthetic hydrophilic polymer materials such as polyvinyl alcohol, partially acetalized polyvinyl alcohol, poly-N-vinylpyrrolidone, polyacrylic acid, polymethacrylic acid, polyacrylamide, polyvinylimidazole, polyvinylpyrazole, etc., and copolymers consisting of the monomer unit contained in the above cited polymers.

Among various types of gelatin, one can use alkaline processed gelatin, acid processed gelatin, the hydrolyzed product therefrom, or the peptized product therefrom with an enzyme.

Suitable gelatin graft polymers are those produced by grafting homopolymers or copolymers of vinyl monomers, such as acrylic acid, methacrylic acid, acrylate and methacrylate ester, acrylamide or methacrylamide, acrylonitrile, styrene, etc., to gelatin. Preferable graft polymers are those with a certain extent of compatibility with gelatin, comprising acrylic acid, methacrylic acid, acrylamide and methacrylamide, hydroxyalkylmethacrylate, etc. Related compounds are described in U.S. Pat. Nos. 2,763,625, 2,831,767 and 2,956,884, etc.

Representative hydrophilic synthetic polymeric materials include those described in, for example, German Patent Application (OLS) No. 2,312,708, U.S. Pat. Nos. 3,620,751 and 3,879,205, Japanese Patent Publication No. 7561/1968.

The prominent features and effects of the present invention will now be explained in more detail.

By practicing the present invention, one can disperse finely and very stably oil-soluble photographic additives such as an oil-soluble coupler, an oil-soluble UV absorbing agent, an oil-soluble antioxidant and an oil-soluble dye precursor without deteriorating the photographic performance of the final product and also without the tendency of particle agglomeration or separation of recrystallized deposit. Further, by using the dispersion prepared in accordance with the present invention, one can produce a photographic light-sensitive product which precipitates no crystalline product after the coating and drying of the dispersion.

Most of the emulsifying agents conventionally used in the photographic art are generally more or less hygroscopic and tend to deteriorate the physical properties of the film on the surface of the product. This fact leads to an unacceptably sticky surface with an increase in the amount of the emulsifier used. By contrast, the combination of the emulsifiers characterizing the present invention exhibit a high degree of emulsifying capability, and a relatively small amount is required, thus the above-cited drawbacks are avoided.

EXAMPLE 1

20 g of the cyan coupler C-1 with the following chemical structure

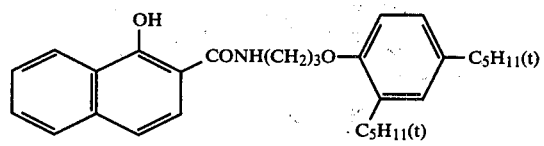

was dissolved together with 1 g of lecithin extracted from soybean into a mixture consisting of 20 g di-n-butyl phthalate and 60 g ethyl acetate with heating at 65° C. The resulting coupler solution was added while stirring to 250 g of a 10% phenylcarbamylated gelatin aqueous solution containing 1.0 g sodium dodecylbenzenesulfonate at 50° C. The mixture was then agitated by means of high-speed homogenizer for 20 minutes to provide Emulsion A, which was passed through a rotary evaporator to remove the ethyl acetate. The mean particle size of the dispersed phase in this emulsion was 0.08 micron.

For the purpose of comparison, Emulsion B was prepared in the same manner except that lecithin extracted from soybean was eliminated. The mean particle size was 0.11 micron.

Furthermore, Emulsion C was prepared for comparison in the same manner as described in Emulsion A except that lime processed gelatin was used in place of the phenylcarbamylated gelatin. The average particle size immediately after the preparation was 0.09 micron.

The three emulsions thus prepared were compared for storage stability by slowly agitating at 40° C. The change in the particle size in Emulsion A, Emulsion B and Emulsion C was traced with time. The results are shown in Table 1. While in Emulsion B for comparison the particles grow in size with time, Emulsion A prepared according to the present invention showed substantially no change in particle size over a 24 hour period. It is evident that the emulsion according to the present invention has a marked stability. Also, in Emulsion C which had been emulsified using a combination system of lecithin and lime processed gelatin, the growth in the particle size with time was observed.

TABLE 1

| Emulsion | Mean Particle Size in Micron | | |
|---|---|---|---|
| | Just after Preparation | After 6 Hours | After 24 Hours |
| A (Present Invention) | 0.08 | 0.08 | 0.08 |
| B (Comparative) | 0.11 | 0.25 | 0.30 |
| C (Comparative) | 0.09 | 0.12 | 0.13 |

EXAMPLE 2

20 g of Coupler C-1 was dissolved into a mixture consisting of 20 g di-n-butyl phthalate and 60 g ethyl acetate by heating to 65° C. The resulting solution was added while stirring to 250 g of a 10% aqueous phthalated gelatin solution containing 1.0 g lecithin extracted from egg yolk and 1.0 g sodium dodecylbenzenesulfonate at 50° C. The mixture thus obtained was emulsified by means of high-speed agitating homogenizer for 20 minutes. The ethyl acetate was removed from the resulting emulsion by rotary evaporator.

The mean particle size in this emulsion designated Emulsion D was 0.10 micron immediately after the preparation.

The storage stability of the emulsion was tested in the same manner as in Example 1. The results are shown in Table 2.

TABLE 2

| Emulsion | Mean Particle Size in Micron | | |
|---|---|---|---|
| | Just after Preparation | After 6 Hours | After 24 Hours |
| Emulsion D (the present invention) | 0.10 | 0.10 | 0.11 |

By comparing the results in Table 1 and Table 2, it is apparent that the use of the lecithin extracted from egg yolk together with phthalated gelatin provides similar results to the use of the lecithin extracted from soybean together with phenylcarbamylated gelatin.

While the invention has been described in detail and with reference to specific embodiments thereof, it will be apparent to one skilled in the art that various changes and modifications can be made therein without departing from the spirit and scope thereof.

What is claimed is:

1. A method for dispersing an oil-soluble photographic additive into a hydrophilic colloid composition comprising dispersing a solution of an oil-soluble photographic additive in an organic solvent or the melted oil-soluble photographic additive in a hydrophilic colloid in the presence of an anionic surface active agent and lecithin together with a gelatin derivative.

2. The method of claim 1, wherein said photographic additive is an oil-soluble photographic color coupler.

3. The method of claim 1, wherein said photographic additive is an oil-soluble antioxidant.

4. The method of claim 1, wherein said photographic additive is an oil-soluble dye precursor for color diffusion transfer process.

5. The method of claim 1, wherein said photographic additive is an oil-soluble UV absorber.

6. The method of claim 1, wherein said hydrophilic colloid is a gelatin derivative.

7. The method of claim 6, wherein said gelatin derivative is a reaction product of gelatin with an acid anhydride, an isocyanate or a compound having an active halogen atom.

8. The method of claim 1, wherein said photographic additive is dissolved in an organic solvent and dispersed in a hydrophilic colloid.

9. The method of claim 8, wherein said lecithin and said anionic surfactant are present in the solution of said photographic additive.

10. The method of claim 8, wherein the solution of said photographic additive is dispersed in said hydrophilic colloid containing said lecithin and said anionic surfactant.

11. The method of claim 8, wherein said solvent is substantially immiscible in water and has a boiling point of at least 190° C. at atmospheric pressure.

12. The method of claim 11, wherein in addition to said solvent a solvent having a boiling point less than 130° C. is present.

13. The method of claim 8, wherein said lecithin and anionic surfactant are used in an amount of about 0.5 to 50% by weight based on the solution of the photographic additive.

14. The method of claim 1, wherein the lecithin and the anionic surface active agent are used in an amount of about 0.5 to 50% by weight based on the weight of the solution or melt of the photographic additive to be dispersed.

15. The method of claim 1, wherein said gelatin derivative is used in an amount of about 1/50 to 10 times by weight based on the weight of the solution or melt to be dispersed.

* * * * *